US006941932B2

(12) United States Patent
Hopley et al.

(10) Patent No.: US 6,941,932 B2
(45) Date of Patent: Sep. 13, 2005

(54) ADVANCE ARRANGEMENT

(75) Inventors: Daniel Jeremy Hopley, Gillingham (GB); Robert Mark Kemsley, Sittingbourne (GB); William Robert Burborough, Gillingham (GB)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/470,041

(22) PCT Filed: Jan. 31, 2002

(86) PCT No.: PCT/GB02/00422

§ 371 (c)(1),
(2), (4) Date: Dec. 22, 2003

(87) PCT Pub. No.: WO02/061250

PCT Pub. Date: Aug. 8, 2002

(65) Prior Publication Data

US 2004/0084029 A1 May 6, 2004

(30) Foreign Application Priority Data

Feb. 1, 2001 (GB) ..... 0102502
Feb. 19, 2001 (GB) ..... 0103975

(51) Int. Cl.[7] ..... F02M 37/04
(52) U.S. Cl. ..... 123/502; 123/450
(58) Field of Search ..... 123/500–503, 123/450, 449, 179.16, 179.17

(56) References Cited

U.S. PATENT DOCUMENTS 3,861,835 A 1/1975 Bakti ..... 417/462
4,037,574 A 7/1977 Swift ..... 123/139
5,370,096 A * 12/1994 Cooke ..... 123/502
5,413,079 A 5/1995 Laufer ..... 123/502
6,041,759 A * 3/2000 Burborough ..... 123/501

FOREIGN PATENT DOCUMENTS

EP 0921300 6/1999
EP 1035311 9/2000

* cited by examiner

*Primary Examiner*—Mahmoud Gimie
(74) *Attorney, Agent, or Firm*—David P. Wood

(57) ABSTRACT

An advance arrangement controls timing of fuel delivery by a fuel pump for use in an engine. The advance arrangement includes an advance piston, a servo piston, a light load piston, and an arrangement. The advance piston is slidable within a first bore and cooperates, in use, with a cam arrangement of a fuel pump to adjust the timing of fuel delivery by the pump. A surface associated with the advance piston is exposed to fuel pressure within a first control chamber. The servo piston is slidable within a further bore provided in the advance piston to control the pressure of fuel within the first control chamber. The servo piston is responsive to speed dependent fuel pressure variations within a servo control chamber, thereby to permit adjustment of the timing in response to engine speed. The light load piston is moveable relative to the advance piston against the action of a light load control spring in response to fuel pressure variations within a light load control chamber. The arrangement ensures the servo piston is substantially unresponsive to speed dependent fuel pressure variations within the servo control chamber, in circumstances in which fuel pressure within the light load control chamber is increased beyond a predetermined amount.

28 Claims, 8 Drawing Sheets

ADVANCE ARRANGEMENT

FIELD OF THE INVENTION

The invention relates to an advance arrangement for use in controlling the timing of fuel delivery by a high pressure fuel pump intended for use in a compression ignition internal combustion engine.

BACKGROUND OF THE INVENTION

In a conventional rotary fuel pump, the angular position of a cam ring is adjusted by means of a servo advance arrangement. The advance arrangement includes an advance piston which is slidable within a bore and which cooperates, in use, with a cam arrangement of the fuel pump to adjust the timing of fuel delivery by the pump. A servo piston is slidable within a further bore provided in the advance piston and a light load sensing piston member is moveable relative to the advance piston against the action of a light load control spring. A servo control spring is engaged between the light load piston member and the servo piston and a control valve is operable to control the application of fuel to the light load piston member to adjust timing under light load conditions. Depending upon the engine load, the pressure of fuel acting on the load sensing piston varies, and the position of the load sensing piston changes. The movement of the load sensing piston results in movement of the servo piston which, in turn, causes movement of an advance piston. The movement of the advance piston causes movement of the cam ring, thereby adjusting the timing of fuel delivery by the pump.

The provision of a light load advance arrangement permits the timing of fuel delivery by the pump to be varied when the engine operates under a light load. The servo piston and the light load piston are arranged to define a light load control chamber for fuel, within which the servo control spring is arranged, a force due to fuel pressure within the light load control chamber acting on the light load piston member, in combination with the light load control spring, to determine the relative axial positions of the light load piston member and the advance piston.

The control valve is arranged to control the pressure of fuel within the light load control chamber by regulating the flow of fuel between the light load control chamber and a low pressure drain. The light load control valve arrangement typically includes a metering valve member which is angularly movable within a bore, the metering valve member being provided with a control edge which cooperates with a port provided in the bore so as to control the rate of flow of fuel out of the control chamber. The pressure of fuel within the control chamber determines the position of the light load piston member and this determines the maximum permitted level of advance. The position of the light load piston member also determines the relationship between engine speed and the rate of adjustment of timing of fuel delivery by the pump.

A problem can arise in fuel pumps of the aforementioned type in that the light load advance arrangement can cause the pressure of fuel delivered by the pump (referred to as 'transfer pressure') to be reduced as the engine load increases. It is desirable, however, to maintain a substantially constant transfer pressure as this improves the speed advance characteristic of the pump.

Another problem associated with the pump of the aforementioned type is that manufacturing variations in the control edge of the metering valve member forming part of the light load control valve arrangement can give rise to undesirable variations in the advance.

It is also known to provide the fuel pump with a cold advance arrangement to permit adjustment of fuel delivery timing depending on engine temperature. The pump includes a temperature control valve arranged to control the application of fuel to the servo or light load piston member depending on the temperature of the engine, thereby permitting adjustment of timing of fuel delivery to compensate for cold conditions.

Such arrangements do, however, suffer from the disadvantage that the cold advance arrangement can become unstable when speed advance is introduced.

It is an object of the present invention to remove or alleviate at least one of the aforementioned problems.

SUMMARY OF THE INVENTION AND ADVANTAGES

According to a first aspect of the present invention, there is provided an advance arrangement for use in controlling timing of fuel delivery by a fuel pump for use in an engine, comprising:

an advance piston which is slidable within a first bore and which cooperates, in use, with a cam arrangement of a fuel pump to adjust the timing of fuel delivery by the pump, a surface associated with the advance piston being exposed to fuel pressure within a first control chamber, a servo piston which is slidable within a further bore provided in the advance piston to control the pressure of fuel within the first control chamber, the servo piston being responsive to speed dependent fuel pressure variations within a servo control chamber, thereby to permit adjustment of the timing in response to engine speed, a light load piston moveable relative to the advance piston against the action of a light load control spring in response to fuel pressure variations within a light load control chamber, and means for ensuring the servo piston is substantially unresponsive to speed dependent fuel pressure variations within the servo control chamber, in circumstances in which fuel pressure within the light load control chamber is increased beyond a predetermined amount.

The invention provides a particular advantage when a cold advance scheme is provided, and in circumstances in which the engine is operating under light load conditions. The invention ensures the servo piston is ineffective, that is unresponsive to speed dependent variations in fuel pressure in the servo control chamber, in circumstances in which light load advance is implemented. As the servo piston is disabled when the temperature control valve is activated, any instability in the cold advance which may otherwise occur when speed advance is introduced can be avoided. The servo piston will effectively be disabled (i.e. unresponsive to fuel pressure variations within the servo control chamber) either in circumstances in which the engine is operating under light load conditions, or under cold conditions.

In one embodiment, the light load piston is shaped to define, in part, a servo piston chamber in communication with the light load control chamber, whereby fuel pressure within the servo piston chamber acts on an end of the servo piston remote from the servo control chamber.

The light load control chamber may communicate with the servo piston chamber through a clearance defined between respective surfaces of the servo piston and the light load piston.

The advance arrangement may also include adjustment means for permitting the extent of travel of the servo piston and/or the light load piston to be adjusted.

The light load piston may include first and second parts which are moveable relative to one another to permit adjustment of the extent of travel of at least one of the light load piston and the servo piston.

The second part of the light load piston may be provided with a blind bore which defines, together with an end surface of the servo piston, the servo piston chamber.

The formation of the light load piston in first and second parts which are movable relative to one another permits the extent of travel of the servo piston and/or the extent of travel of the light load piston to be adjusted prior to installation in the pump. Conveniently, the first and second parts are in screw threaded connection such that the extent of travel of the piston(s) is varied depending upon how far one part is screwed into the other.

The advance arrangement may also include a temperature control valve operable to control the application of fuel to the light load piston depending upon the engine temperature, thereby to permit adjustment of the timing of fuel delivery depending on engine temperature.

The temperature control valve may be arranged such that, when the engine temperature is less than a predetermined temperature, the temperature control valve is activated so as to permit fuel pressure within the light load control chamber to be increased, the temperature control valve being de-activated when the engine temperature exceeds the predetermined temperature.

The advance piston is typically arranged to be moveable within the first bore in an advance direction, in which the timing of fuelling delivery by the pump is advanced, and a retard direction in which the timing of fuelling delivery by the pump is retarded. The advance arrangement may further comprise a cold advance supply passage through which fuel is supplied to the light load control chamber when the temperature control valve is activated, the cold advance supply passage being arranged to communicate with the light load control chamber only when the extent of movement of the advance piston in the advance direction is less than a predetermined amount.

The advance piston may also have an outer surface provided with a recess in communication with the light load control chamber which defines a control edge, and whereby communication between the cold advance supply passage and the light load control chamber is broken when the control edge becomes misaligned with the cold advance supply passage upon movement of the advance piston beyond the predetermined amount.

The advance arrangement may also include a light load supply passage for supplying a signal pressure to the light load control chamber, wherein the light load supply passage communicates with a flow path for fuel between a source of fuel at transfer pressure and a low pressure drain, and a light load control valve arrangement which is operable in response to a load dependent control signal to vary the rate of flow of fuel through the flow path and, hence, to vary the signal pressure, thereby to permit the timing under light load conditions to be adjusted, wherein the light load control valve arrangement is arranged in the flow path at a position upstream of the light load supply passage.

The light load control chamber may be provided with a restricted outlet arrangement to permit fuel within the light load control chamber to flow to a low pressure fuel reservoir at a restricted rate. The advance arrangement may further comprise further adjustment means for adjusting the effective restriction to fuel flow provided by the restricted outlet arrangement.

The restricted outlet arrangement may further comprise a first restricted outlet having a variable diameter, and a second restricted outlet of substantially fixed diameter, whereby the further adjustment means is adjustable to vary the diameter of the first restricted outlet.

The further adjustment means may include a valve member arranged within an additional bore, whereby adjusting the position of the valve member within the additional bore permits the diameter of the first restricted outlet to be varied.

Conveniently, the first restricted outlet is of annular form and is defined, in part, by the valve member.

In one embodiment of the invention, the servo piston is arranged to carry a sleeve, conveniently forming a close fit on the servo piston, wherein the sleeve is provided with an orifice to restrict the rate of flow of fuel between the light load control chamber and the servo piston chamber, and serving to damp movement of the servo piston relative to the light load piston.

According to a second aspect of the present invention an advance arrangement comprises:

an advance piston which is slidable within a first bore and which cooperates, in use, with a cam arrangement of a fuel pump to adjust the timing of fuel delivery by the pump, a surface associated with the advance piston being exposed to fuel pressure within a first control chamber, a piston moveable relative to the advance piston against the action of a control spring in response to fuel pressure variations within a control chamber, a supply passage for supplying fuel at a signal pressure to the control chamber, wherein the supply passage communicates with a flow path between a source of fuel at transfer pressure and a low pressure drain, and a control valve arrangement, operable to vary the rate of flow of fuel through the flow path and, hence, to vary the signal pressure, wherein the control valve arrangement is arranged in the flow path at a position upstream of the supply passage.

In one embodiment, the piston takes the form of a light load piston which is moveable relative to the advance piston against the action of a light load control spring in response to signal pressure variations within a light load control chamber.

The advance arrangement according to this aspect of the invention may further comprise a servo piston which is slidable within a further bore provided in the advance piston to control the pressure of fuel in the first control chamber, the servo piston being responsive to speed dependent fuel pressure variations within a servo control chamber, thereby to permit adjustment of the timing in response to engine speed.

The light load control chamber may be arranged to communicate with a relatively low pressure fuel reservoir through a flow path which provides a substantially fixed restriction to the flow of fuel.

In conventional advance arrangements, the light load control valve arrangement controls the application of fuel to the light load piston member by regulating the flow of fuel between the light load control chamber and the low pressure drain, so the light load control valve arrangement is arranged downstream of the light load supply passage, between the point at which signal pressure is tapped off from the flow path between transfer pressure and the low pressure drain, and the low pressure drain. This can cause an undesirable reduction in transfer pressure as the engine load increases. The present invention provides a particular advantage that the transfer pressure delivered by the pump is maintained at a substantially constant value in circumstances in which the light load advance is activated.

In one embodiment, the advance arrangement comprises adjustment means for permitting the restriction provided by the flow path to be adjusted.

The flow path may also include a first restricted outlet, the adjustment means comprising a valve member which is adjustable relative to the restricted outlet to vary the restriction to fuel flow presented by the first restricted outlet.

The flow path may also include a second restricted outlet which presents a substantially fixed restriction to the flow of fuel.

By providing adjustment means to permit adjustment of the restriction provided by the flow path, fine control of the advance characteristic of the pump can be achieved. The provision of the adjustment means enables the degree of advance to be varied so as to give the required fuelling level at a given engine speed.

According to a third aspect of the present invention, an advance arrangement for use in controlling timing of fuel delivery by a fuel pump for use in an engine comprises:

an advance piston which is slidable within a first bore and which cooperates, in use, with a cam arrangement of a fuel pump to adjust the timing of fuel delivery by the pump, a surface associated with the advance piston being exposed to fuel pressure within a first control chamber, a piston moveable relative to the advance piston against the action of a control spring in response to fuel pressure variations within a control chamber, wherein the control chamber is provided with a restricted outlet arrangement to permit fuel within the control chamber to flow to a low pressure fuel drain at a restricted rate, and adjustment means for permitting the effective restriction to fuel flow provided by the restricted outlet arrangement to be varied.

In one embodiment, the piston takes the form of a light load piston which is moveable relative to the advance piston against the action of a light load control spring in response to signal pressure variations within a light load control chamber.

The advance arrangement according to this aspect of the invention may further comprise a servo piston which is slidable within a further bore provided in the advance piston to control the pressure of fuel in the first control chamber, the servo piston being responsive to speed dependent fuel pressure variations within a servo control chamber, thereby to permit adjustment of the timing in response to engine speed.

According to a fourth aspect of the present invention, an advance arrangement for use in controlling timing of fuel delivery by a fuel pump for use in an engine comprises:

an advance piston which is slidable within a first bore and which cooperates, in use, with a cam arrangement of a fuel pump to adjust the timing of fuel delivery by the pump, a surface associated with the advance piston being exposed to fuel pressure within a first control chamber, and a light load piston moveable relative to the advance piston against the action of a light load control spring in response to load dependent fuel pressure variations within a light load control chamber, thereby to adjust the timing under light load conditions, wherein the light load piston includes first and second parts which are moveable relative to one another to permit adjustment of the extent of travel of the light load piston.

The first and second parts of the light load piston may be in screw threaded connection with one another.

This aspect of the invention may also include a servo piston which is slidable within a further bore provided in the advance piston to control the pressure of fuel in the first control chamber, the servo piston being responsive to speed dependent fuel pressure variations within a servo control chamber, thereby to permit adjustment of the timing in response to engine speed. The advance arrangement may be arranged such that adjustment of the light load piston relative to the servo piston also permits adjustment of the extent of travel of the servo piston.

It will be appreciated from the following description that one or more of the features of one aspect of the invention may be employed in any one or more of the other aspects of the invention, alone or in combination with one another.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

A conventional rotary fuel pump includes a cam ring (not shown) which is angularly adjustable with respect to a pump housing. The cam ring includes a plurality of cam lobes and encircles part of a distributor member, including pumping plungers which are slidable within respective bores of the distributor member. Each of the pumping plungers has an associated shoe and roller arrangement, the rollers of which are engagable with the cam surface of the cam ring. In use, fuel is supplied to the bores of the distributor member by a transfer pump and a force due to fuel pressure within the bores serves to urge the plungers in a radially outward direction. The output pressure of the transfer pump (referred to as "transfer pressure") is controlled so as to be related to the speed of operation of the engine with which the pump is being used. Rotation of the distributor member relative to the cam ring causes the rollers to move relative to the cam ring, engagement between the rollers and the cam lobes thereby causing the plungers to be forced in a radially inward direction to pressurise fuel within the respective bore and causing fuel to be delivered by the pump at relatively high pressure. By altering the angular position of the cam ring by means of an advance arrangement, the timing at which fuel is delivered by the pump can be adjusted.

As will be described in further detail hereinafter, the advance arrangement includes a servo piston arrangement which is arranged to influence the degree of timing advance depending on the operating speed of the engine (referred to as "speed advance"), a light load piston arrangement, including a load sensing piston, which is arranged to influence the degree of timing advance depending on the load under which the engine is operating (referred to as "light load advance") and a temperature control valve which is arranged to influence the degree of timing advance depending on the operating temperature of the engine (referred to as "cold advance").

Figure 1:
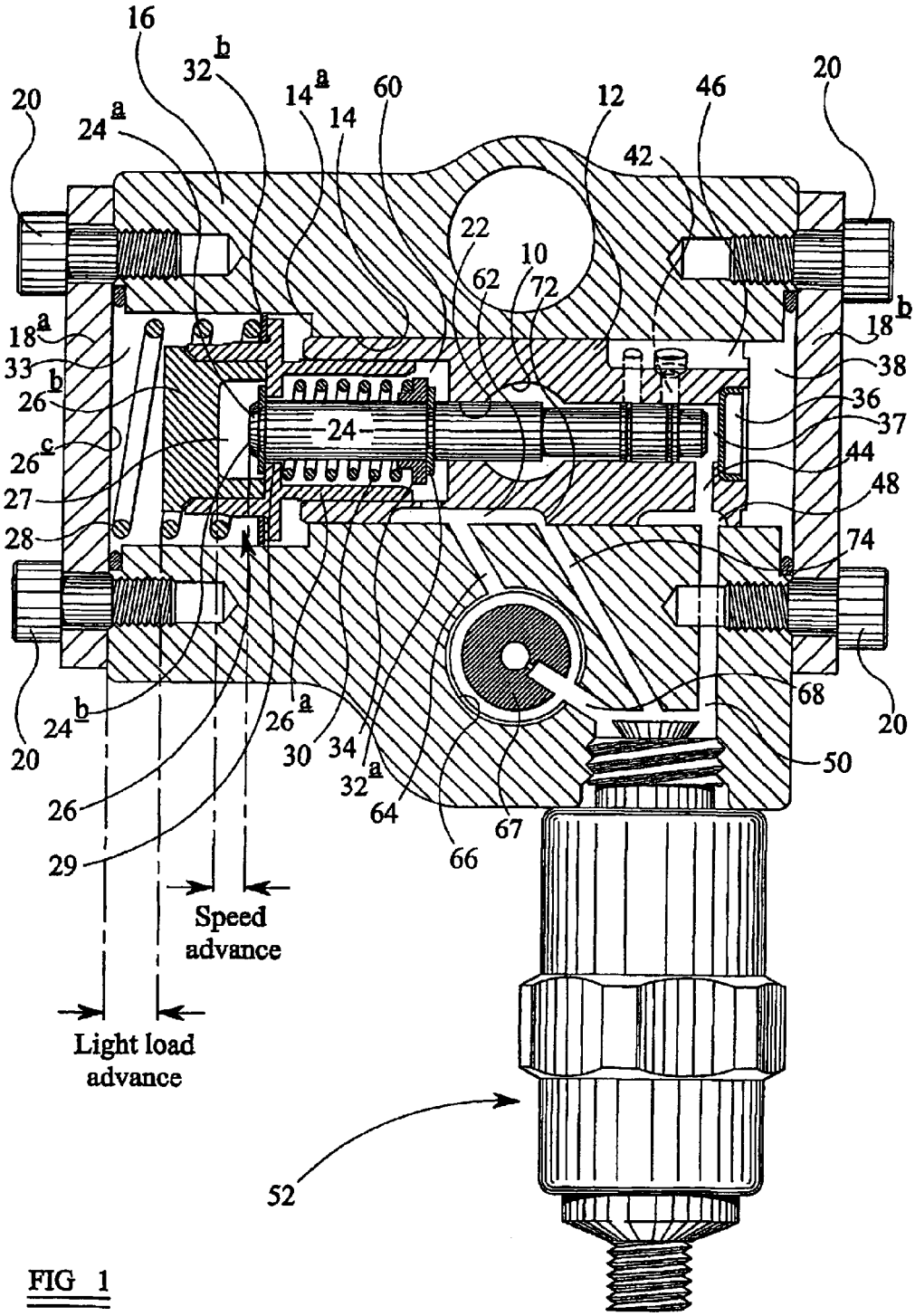
FIG. 1 is a view, part in section, of an advance arrangement in accordance with a first embodiment of the invention.

FIG. 1 shows an embodiment of the present invention in which the cam ring is provided with a peg (not shown) which extends into an opening 10 provided in an advance piston 12 in order to permit adjustment of the angular position of the cam ring. The advance piston 12 is slidable within a further bore 14 provided in an advance box housing 16. The ends of the bore 14 are closed by first and second end plates 18*a* 18*b* respectively which are secured to the advance box housing 16 by means of bolts 20. Appropriate O-rings may be used to seal the end plates 18*a*, 18*b* to the advance box housing 16.

The advance piston 12 includes an axially extending bore 22 within which a servo piston 24 is slidable. The bore 22 is shaped to include an enlarged region within which a first part 26*a* of a light load sensing piston 26 is received. The first part of the light load piston 26 carries a flange, an inner portion of which defines a central opening through which the servo piston 24 extends. The servo piston 24 is a sliding fit within this central opening, and within the bore 22 provided in the advance piston 12, and acts to guide movement of the light load piston 26, in use. The light load piston 26 also includes a second part 26*b* typically in the form of a screw threaded piece, which is received within a screw threaded bore in the first part 26*a* of the light load piston 26. The second part 26*a* of the light load piston is provided with a blind bore, a surface 26*c* at the blind end of the bore defining, together with an end surface of the servo piston 24, a servo piston chamber 27 at a first end of the servo piston 24. An annular clearance 29 is defined between an outer surface of the servo piston 24 and an inner surface of the first part 26*a* of the light load piston 26 to permit communication between the servo piston chamber 27 and a light load control chamber 60, as will be described in further detail below.

A light load control spring 28 is arranged within an end chamber 33 defined, in part, by the bore 12 in the advance box housing 16 and the first end plate 18*a*, the light load control spring 28 being engaged between the light load piston 26 and the first end plate 18*a* to bias the light load piston 26 into engagement with a step 14*a* defined by part of the bore 14. A servo control spring 30 is engaged between the light load piston 26 and a first annular member 32*a* carried by the servo piston 24. A shim 34 is located between the servo control spring 30 and the first annular member 32. The servo piston 24 also includes an enlarged end region 24*a* which defines an end surface of the servo piston 24, the end region 24*a* being in abutment with a second annular member 32*b* carried by the servo piston which, in the position shown in FIG. 1, abuts an axially facing surface the inner portion of the flange on the first light load piston part 26*a*. The maximum permitted movement of the servo piston 24 relative to the light load piston 26 occurs when an end surface of the servo piston 24 engages the end surface 26*c* of the blind bore in the second part 26*b* of the light load piston 26.

The position of the second part 26*b* of the light load piston 26 relative to the first part 26*a* determines the extent of travel of the composite light load piston 26, the extent of travel being defined by the gap between the end of the second part 26*b* of the light load piston 26 and the end plate 18*b*. It will therefore be appreciated that the extent to which the second part 26*b* of the light load piston 26 is screwed into the first part 26*a* will determine the extent of travel of the servo piston 24 and of the light load piston 26. The formation of the light load piston 26 in two parts which are axially movable relative to one another therefore provides an adjustment means for adjusting the extent of travel of the light load piston 26 and the servo piston 24. It will also be appreciated that the position of the light load piston 26 relative to the end plate 18*a* determines the maximum permitted level of advance.

In practice, it may be desirable to provide the light load piston 26*a*, 26*b* with a seal arrangement (not shown), typically in the form of an O-ring, to provide a substantially fluid-tight seal between the servo piston chamber 37 and the end chamber 33. A locking arrangement (not shown), typically in the form of a locking nut, may also be provided to secure the first and second parts 26*a*, 26*b* of the light load piston 26 in position on assembly of the arrangement. In an alternative embodiment, the friction of the O-ring seal may be sufficient to ensure the first and second parts 26*a*, 26*b* are secured together, in which case the need for the locking arrangement is removed.

At the end of the bore 22 remote from the light load piston 26, a disc-shaped member 36 is arranged within an annular groove provided in the advance piston 12. Movement of the servo piston 24 relative to the advance piston 12 is limited by engagement between the first annular member 32 and a part of the bore 22 provided in the advance piston 12. The disc-shaped member 36 defines, together with a part of the bore 22 provided in the advance piston 12, a servo control chamber 37 at a second end of the servo piston 24 for receiving fuel, a force due to fuel pressure within the servo control chamber 37 acting on the end surface of the enlarged region 24*a* of the servo piston 24 so as to urge the servo piston 24 towards the left in the illustration shown in FIG. 1 against the force due to the servo control spring 30. Fuel is delivered to the servo control chamber 37 through a servo supply passage 50 provided in the advance box housing 16. For the purpose of this specification, the pressure of fuel within the servo control chamber 37 shall be referred to as "servo control pressure", the servo control pressure being dependent upon the speed at which the engine operates.

A first control chamber 38 is defined by an end face of the advance piston 12 remote from the light load piston 26, the associated part of the bore 14 and the second end plate 18*b*. The first control chamber 38 communicates, via a channel 46 formed in the outer periphery of the advance piston 12, with a radially extending passage 42 within which a non-return valve (not shown) is located. The radially extending passage 42 communicates with the bore 22 in the advance piston 12 and, depending on the position of the servo piston 24, the radially extending passage 42 may communicate with a second radially extending passage 44 provided in the advance piston 12. The second radially extending passage 44 opens into a recess 48 provided in the outer surface of the advance piston 12. The recess 48 is located so that for all permitted positions of the advance piston 12 relative to the advance box housing 16, the recess 48 communicates with the servo supply passage 50 defined in the advance box housing 16.

As mentioned previously, the advance piston 12 and the light load piston 26 together define a light load control chamber 60 within which the servo control spring 30 is arranged, the light load control chamber 60 being in constant communication, by means of the clearance 29, with the servo piston chamber 27 at the left hand end of the servo piston 24 (in the orientation shown in FIG. 1). The light load control chamber 60 also communicates with an additional recess 62 provided in the outer surface of the advance piston 12. The additional recess 62 is arranged such that, for all permitted positions of the advance piston 12, the additional recess 62 communicates with a light load supply passage 64. The light load supply passage 64 communicates with a bore 66 provided in the advance box housing 16 such that fuel can be delivered to the light load control chamber 60, in use, and hence to the servo piston chamber 27, the pressure of fuel delivered to the light load control chamber 60 (referred to as "signal pressure") depending upon the load under which the engine operates.

The bore 66 receives a passage defining member 67 which ensures a second supply passage 68 defined in the advance box housing 16 communicates constantly with fuel at transfer pressure. In use, fuel at transfer pressure is supplied through the second supply passage 68, from where it flows into the servo supply passage 50.

The additional recess 62 provided on the outer surface of the advance piston 12 defines a control edge 72 and, depending on the axial position of the advance piston 12, may communicate with a cold advance supply passage 74 defined in the advance box housing 16. An electromagnetically operated temperature control valve 52 is mounted upon the cam box housing 16 to control the supply of fuel through the cold advance supply passage 74. Typically, the temperature control valve 52 takes the form of a conventional stop solenoid, supplied with electrical current only when the engine is at a relatively low temperature. The temperature control valve 52 is therefore only in an open position when the engine is cold. Conveniently, activation of the temperature control valve 52 is controlled by means of a temperature sensor arranged to sense the temperature of the engine water jacket.

Under normal operating conditions, where the engine is hot, the temperature control valve 52 is closed such that fuel at transfer pressure is supplied only through the second supply passage 65, but is not supplied through the temperature control valve 52 to the cold advance supply passage 74.

In use, fuel delivered through the light load supply passage 64 to the light load control chamber 60 acts on the light load piston 26 to oppose the force due to the light load control spring 28. If signal pressure in the light load control chamber 60 is relatively low, the light load piston 26 is biased by means of the light load spring 28 into engagement with the step 14*a* defined by the bore 14. However, if fuel pressure within the light load control chamber 60 is increased sufficiently, the light load piston member 26 will be urged away from the step 14*a* into the position shown in FIG. 1, such that the advance characteristic is altered.

Figure 2:
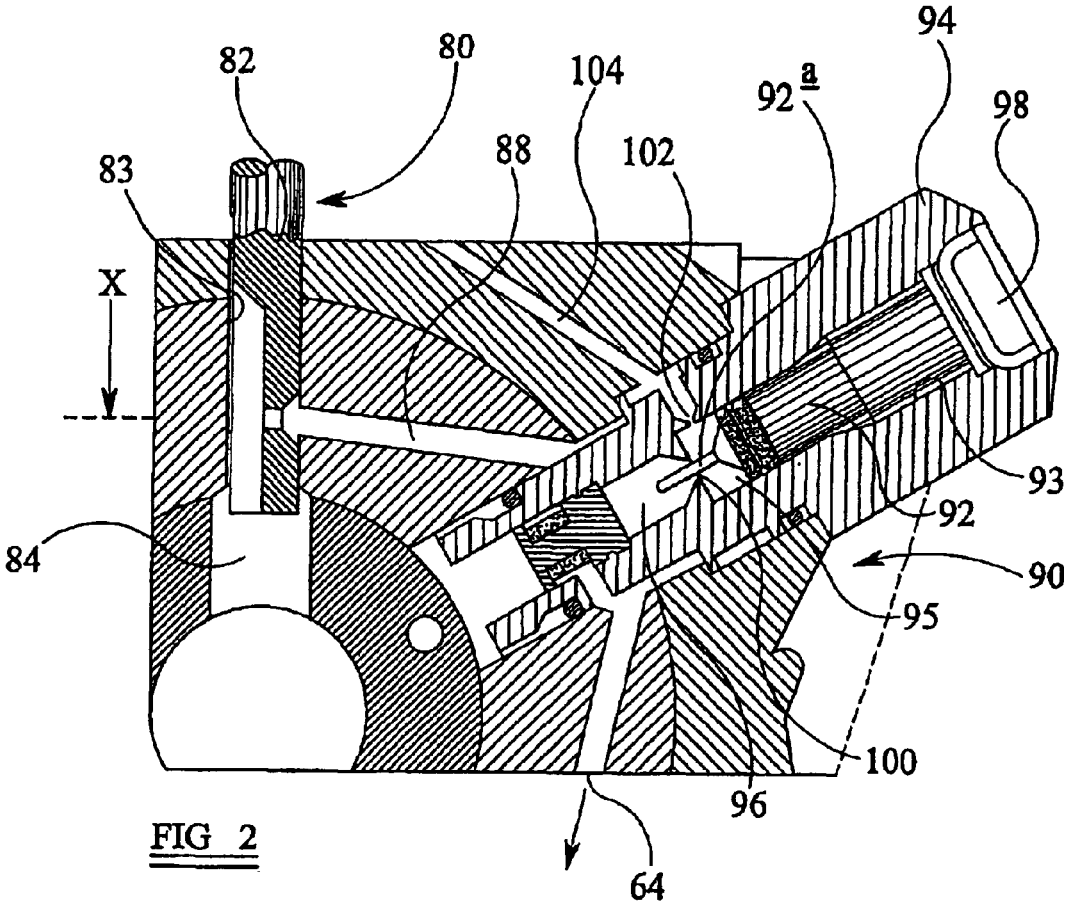
FIG. 2 is a sectional view of a part of the advance arrangement shown in FIG. 1.
Figure 3:
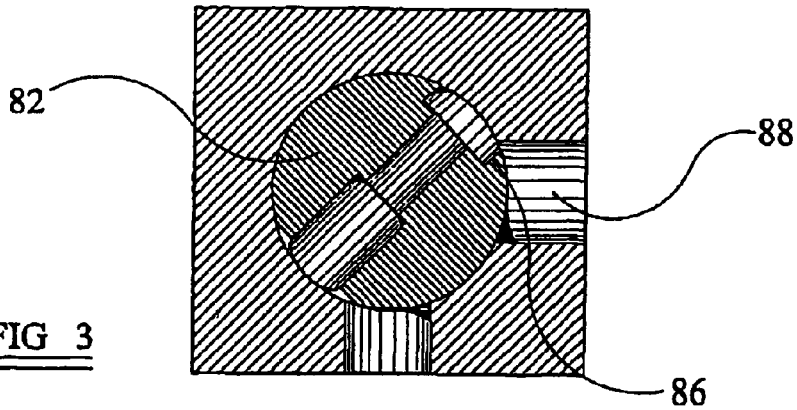
FIG. 3 is a sectional view, along line X—X, showing a part of the advance arrangement in FIG. 2.

The pressure of fuel supplied through the light load supply passage 64 to the additional recess 62 is regulated by means of a metering valve arrangement 80, as shown in FIGS. 2 and 3. The metering valve arrangement 80 therefore controls the pressure of fuel within the light load control chamber 60 which controls the position of the light load piston 26 relative to the advance piston 12

The metering valve arrangement 80 includes a metering valve member 82 arranged within a metering valve bore 83. The angular position of the metering valve member 82 within the bore 83 is adjustable in response to a load dependent control signal to vary the rate of flow of fuel through an inlet passage 84, arranged to receive fuel at transfer pressure, to an outlet passage 88 in communication with the light load supply passage 64. The metering valve member 82 is provided with a drilling which defines a control edge 86, the amount of fuel flowing through the metering valve arrangement 80, and hence the pressure of fuel supplied to the light load supply passage 64 to be delivered to the light load control chamber 60, being determined by the position of the control edge 86 relative to the outlet passage 88.

Fuel flowing from the outlet passage 88 to the light load supply passage 64 flows through an adjustable valve arrangement, referred to generally as 90, including a valve member 92 arranged within a further bore 93 which defines a chamber 95. The valve member 92 is in screw threaded connection with the further bore 93 such that the axial position of the valve member 92 within the further bore 93 is adjustable. The further bore 93 is shaped to define a part of a branch flow passage 96 for fuel between the outlet passage 88 and the light load supply passage 64. The further bore 93 is also shaped to include a region of relatively small diameter through which a projecting region 92*a* of the valve member 92 extends. It will be appreciated that the position of the projecting region 92*a* of the valve member 92 relative to the region of relatively small diameter can be adjusted by adjusting the position of the valve member 92 within the further bore 93.

The projecting region 92*a* of the valve member 92 and the region of relatively small diameter in the flow passage 96 together define an annular outlet 100 of restricted diameter. The chamber 95 communicates, by means of a further restricted outlet 102 arranged in series with the annular outlet 100, with a relief passage 104 in communication with a low pressure fuel reservoir. Typically, the cam box is at relatively low pressure (commonly referred to as "cam box pressure") such that the relief passage 104 is in communication with the cam box. It will be appreciated, however, that the cam box need not be at relatively low pressure, for example it may be at transfer pressure, in which case the relief passage 104 communicates with an alternative low pressure reservoir. As fuel flows through the passages 88, 96 into the light load supply passage 64, a small amount of fuel is also able to flow, at a relatively low rate, through the annular outlet 100, into the chamber 95 and through the further restricted outlet 102 to the cam box. The annular outlet 100 and the further restricted outlet 102 therefore form a restricted outlet arrangement, the rate at which fuel is able to flow to the cam box being determined by the effective restriction to fuel flow provided by the restricted outlet arrangement 100, 102. It will therefore be appreciated that the effective restriction to fuel flow provided by the restricted outlet arrangement 100, 102 is determined by the position of the valve member 92 within the bore 93.

As an alternative to that shown in FIGS. 2 and 3, it may be more convenient to define the control edge 86 by means of an axially extending recess or slot provided on the surface of the metering valve member 82, rather than by providing a radially extending drilling through the member 82.

Figure 4:
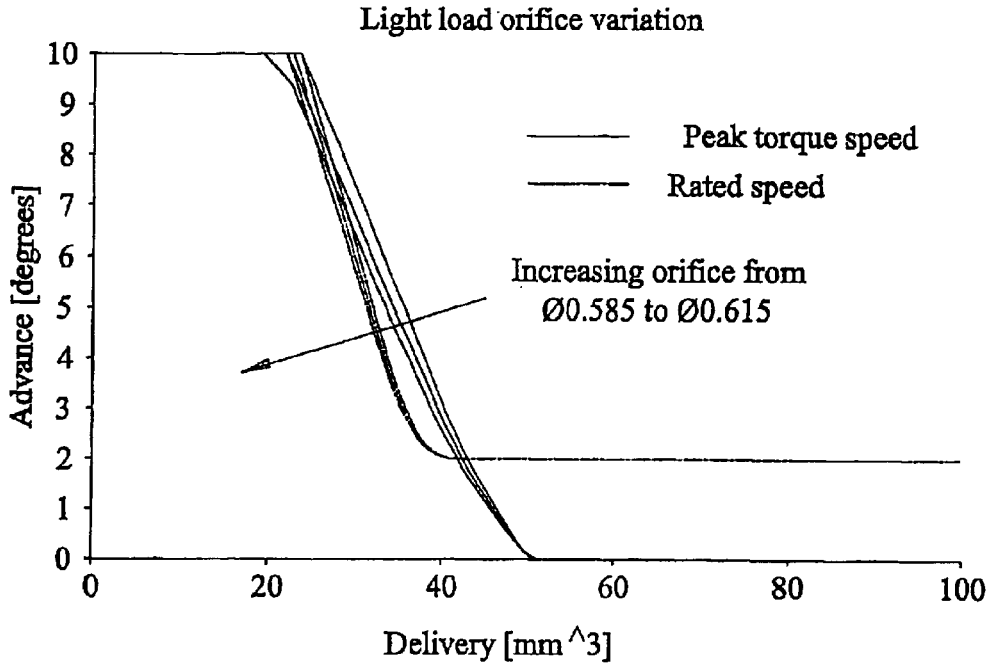
FIGS. 4(*a*) to 4(*d*) illustrate the degree of advance as a function of pump delivery flow for varying pump parameters.
Figure 4:
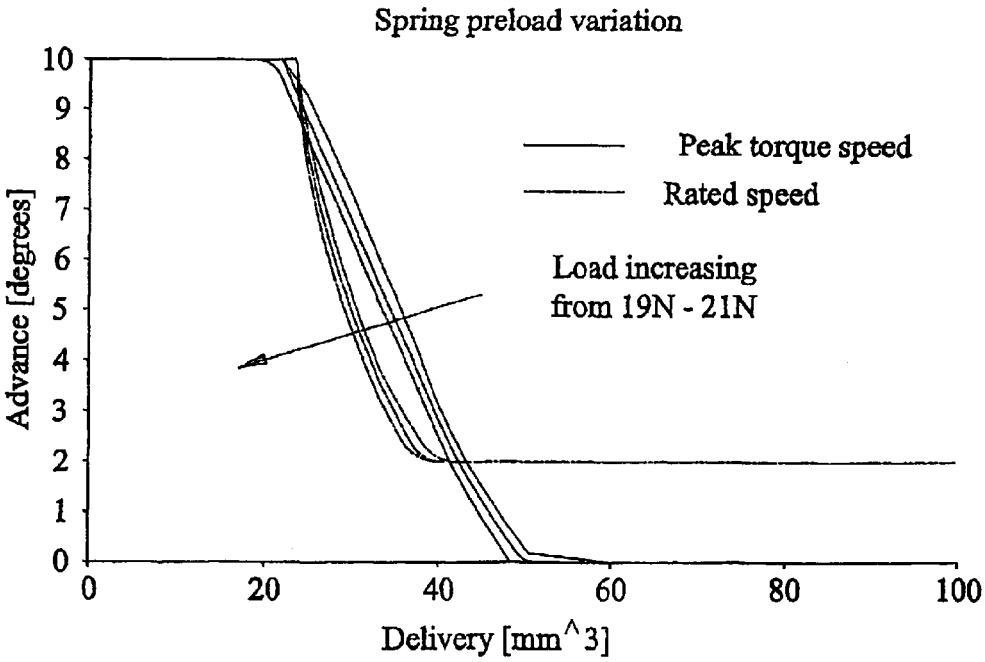
Figure 4:
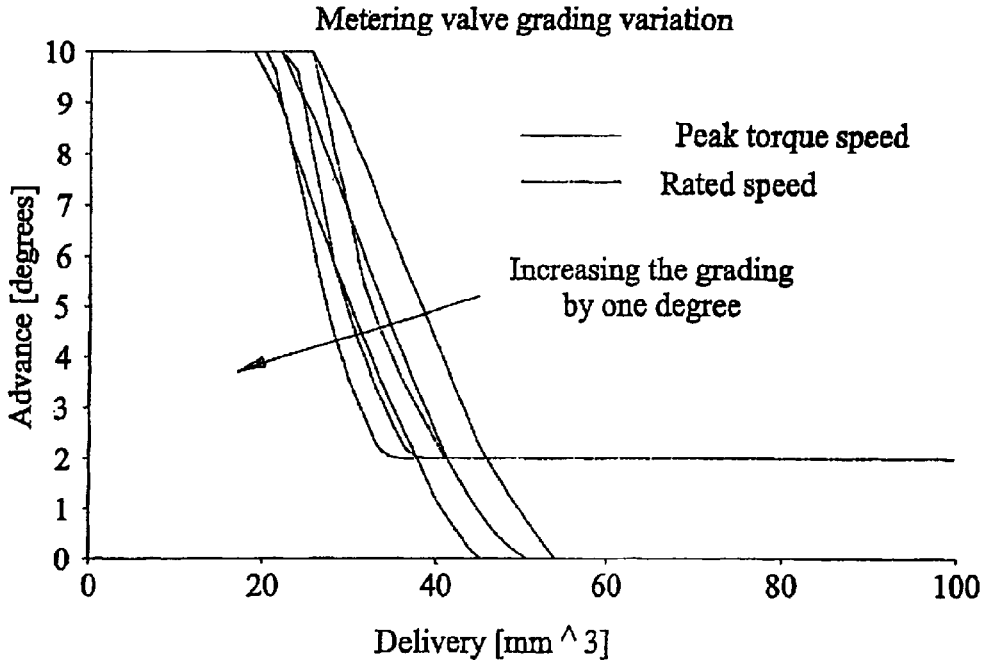
Figure 4:
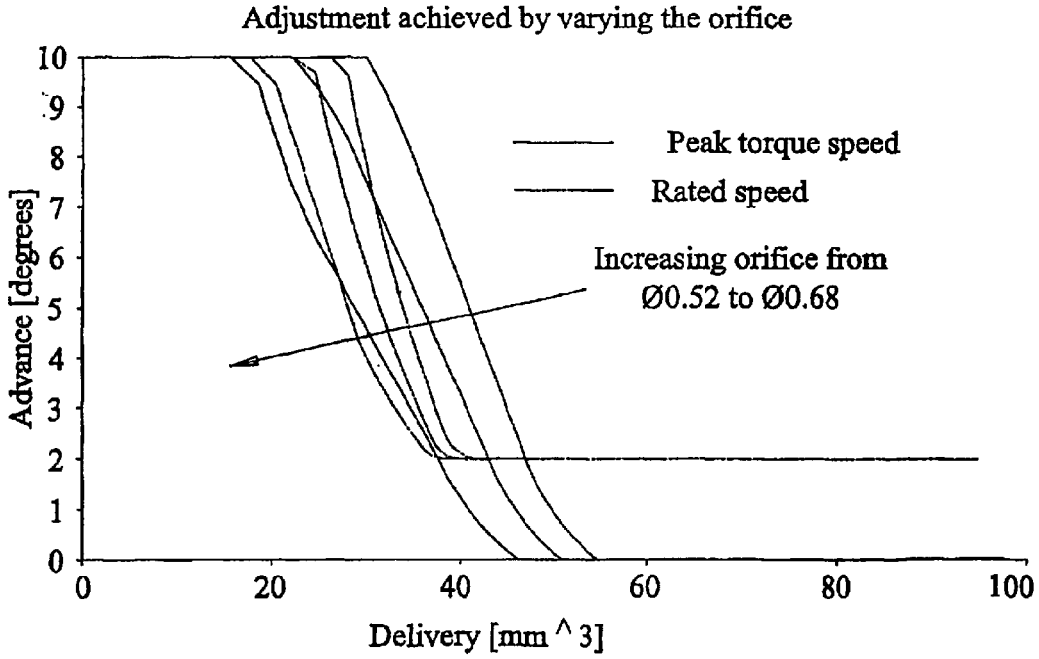

FIG. 4(*a*) illustrates the degree of advance of a conventional pump as a function of fuel delivery flow, at both a peak torque speed and a rated speed, where the restriction to fuel flow from the light load control chamber is through an orifice of fixed diameter. FIG. 4(*a*) shows the effect on the advance characteristic of varying the diameter of the orifice from 0.585 mm to 0.615 mm. Any error during manufacture in the selected diameter of the orifice will therefore influence the advance characteristic of the pump.

Similarly, FIG. 4(*b*) shows the effect of varying the pre-load of the light load control spring 28 on the advance characteristic and FIG. 4(*c*) illustrates the effect of varying the position of the control edge 86 of the metering valve arrangement 80 on the advance characteristic. With reference to FIG. 4(*c*), it can be seen that a variation of one degree in the position of the control edge 86 has a substantial effect on the degree of advance achieved for a given delivery flow rate. Any variations in the position of the control edge 86 during manufacture will influence the pressure of fuel which is delivered to the light load control chamber 60 for a given position of the metering valve member 82. Hence, the light load advance characteristic of the pump will vary depending on the accuracy with which the position of the control edge 86 of the metering valve member 82 is machined. It will be appreciated that it is a variation in the relative positioning of the control edge 86 and the outlet passage 88 which will affect the light load characteristic, and that this may also arise as a result of manufacturing variations in the position of the outlet passage 88.

As can be seen in FIG. 4(*d*), the provision of the adjustable valve arrangement 90 is advantageous as it permits fine control of the light load control characteristic. Any variation in the position of the control edge 86 on the metering valve member 82 and/or of the outlet passage 88 can therefore be compensated for. Additionally, any variation in the pre-load of the light load control spring 28 can also be compensated for.

Prior to installation in an engine, the pump is tested on test equipment and the position of the valve member 92 is adjusted until the desired advance-delivery flow characteristic is achieved. A tamper proof cover or seal member 98 is then arranged to fix the valve member 92 in the desired position prior to installation of the pump in the engine.

Figure 5:
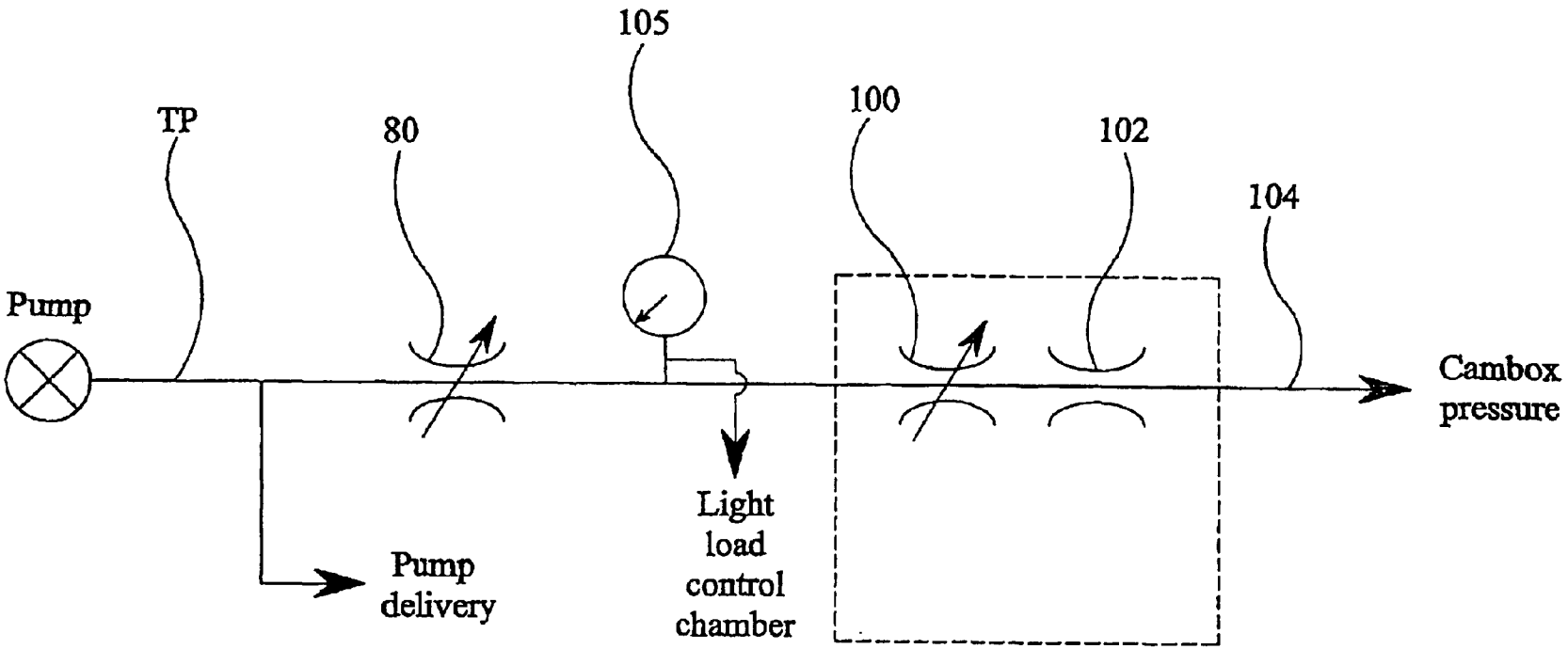
FIG. 5 is a hydraulic circuit diagram for the advance arrangement shown in FIGS. 1 to 3.

FIG. 5 shows a schematic diagram of the flow path between a transfer pump for delivering fuel to the engine, a point at which signal pressure is tapped off to the light load control chamber 60 (as shown in FIG. 1) and the cam box. The pressure of fuel delivered to the light load control chamber 60 through the outlet passage 88 and the light load supply passage 64 is represented by the pressure gauge 105 and this will be determined by the angular position of the metering valve member 82 within the bore 83, and the effective restriction to fuel flow provided by the first and further restricted outlets 100, 102 to the cam box through the relief passage 104. The metering valve arrangement 80 is located in the flow path between the transfer pump and low pressure (i.e. the cam box) at a position upstream of the light load control chamber 60 and controls the rate of flow of fuel through this flow path between the transfer pump and the cam box.

Figure 6:
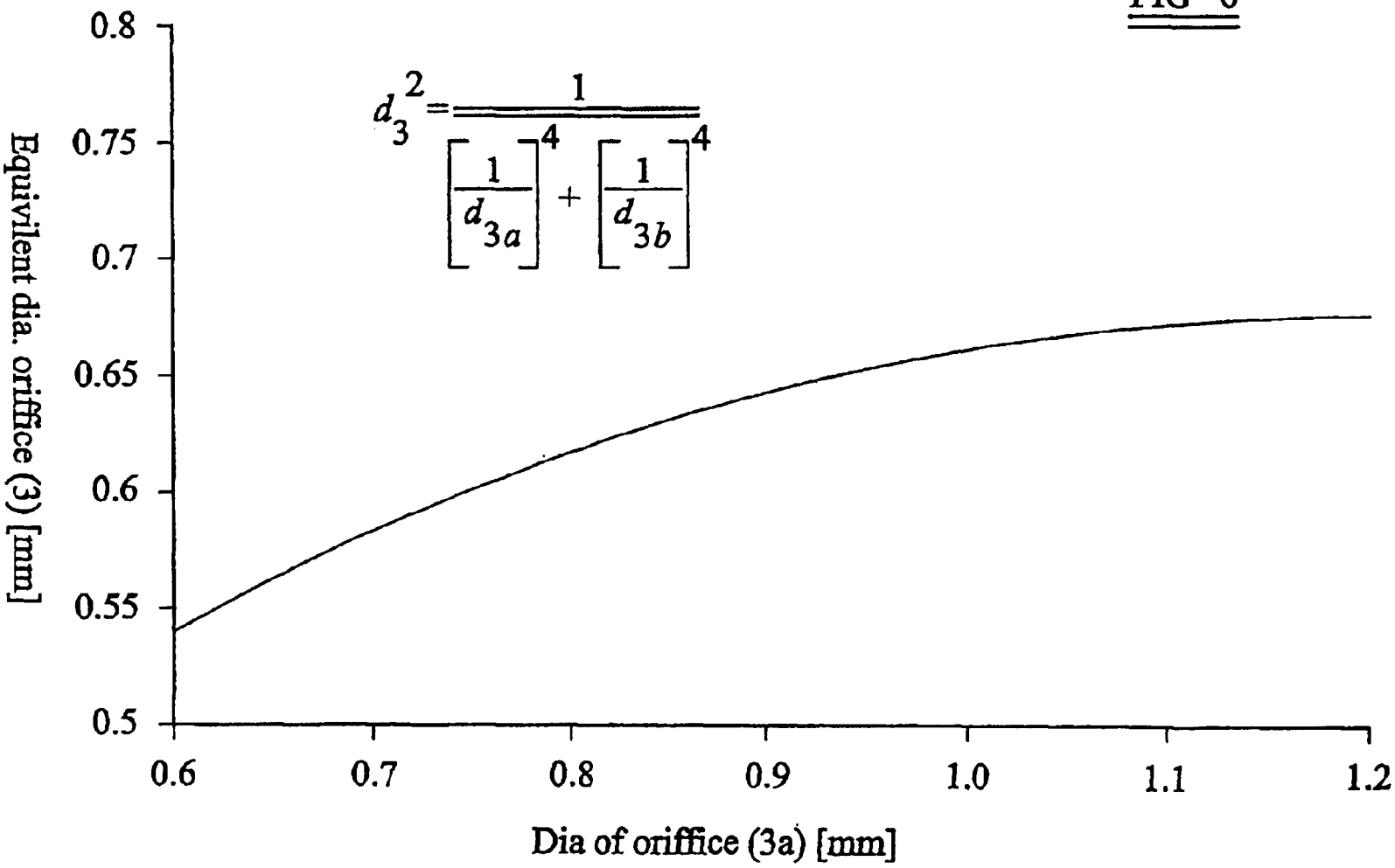
FIG. 6 is a graph to show the effect of varying the diameter, d3*a*, of a first restricted outlet on the effective diameter, d3, of a restricted outlet arrangement comprising the first restricted outlet and a second restricted outlet of fixed diameter.

FIG. 6 illustrates the effect of varying the diameter of the outlet 100 on the equivalent, effective diameter of the two-outlet arrangement 100, 102. It can be seen that, for a relatively large increase in the diameter of the annular outlet 100, only a relatively small increase in the effective diameter of the two-outlet arrangement 100, 102 is achieved. FIG. 5 therefore illustrates how the provision of the variable restricted outlet 100 and the adjustable valve arrangement 90 permits fine control of the pressure of fuel delivered to the light load control chamber 60 and, hence, the light load advance characteristic.

In a conventional arrangement, the flow path for fuel between the transfer pump and the light load control chamber is provided with a restriction of fixed diameter and a metering valve arrangement is arranged downstream of the light load control chamber to regulate the flow of fuel between the point at which signal pressure is tapped off from the flow path to the cam box. However, problems can arise due to the increased flow of fuel to low pressure, through the metering valve arrangement, as engine load increases. The increased flow for higher engine loads can cause the pressure of fuel delivered by the pump to be reduced. By locating the metering valve arrangement 80 in the flow path between the transfer pump and the cam box at a position upstream of the point at which signal pressure is fed to the light load control chamber 60 (i.e. upstream of the light load supply passage 64), and by providing the relief passage 104 to cam box with a restricted outlet of substantially fixed, effective diameter, this problem can be avoided.

It will be appreciated that the benefit of arranging the metering valve arrangement 80 between the transfer pump and the light load control chamber, as opposed to providing the metering valve arrangement between the light load control chamber and the cam box, is achieved even if the adjustable valve arrangement 90 is not provided and only a single restricted outlet of fixed diameter is provided in the outlet passage 104 to the cam box.

In use, under normal operating conditions where the engine is hot, the temperature control valve 52 is switched so that fuel at transfer pressure is supplied through the metering valve arrangement 80 into the light load supply passage 64, but is not supplied to the cold advance supply passage 74. Under such circumstances, fuel pressure within the light load control chamber 60 is relatively low and, thus, the light load piston 26 is biased by means of the light load spring 28 into engagement with the step 14*a* defined by the bore 14. Fuel at transfer pressure is also supplied through the servo supply passage 50, into the recess 48 and through the passage 44 provided in the advance piston 12 into the servo control chamber 37. With the servo piston 24 in the position shown in FIG. 1, fuel delivered to the servo control chamber 37 is unable to flow through the radially extending passage 42 into the first control chamber 38.

Should the speed of rotation of the engine increase, resulting in an increase in transfer pressure, the pressure supplied to the servo control chamber 37 is increased. An increased force is therefore applied to the end surface 24*a* of the servo piston member 24 which serves to urge the servo piston member 24, against the action of the servo control spring 30, to a position in which communication between the servo control chamber 37 and the radially extending passage 42 is permitted. In these circumstances, fuel flows from the servo control chamber 37, through the radially extending passage 42 and past the non-return valve into the first control chamber 38. The flow of fuel to the control chamber 38 increases fuel pressure therein, thereby applying a force to the advance piston 12 which causes the advance piston 12 to move towards the left in the orientation illustrated in FIG. 1. Movement of the advance piston 12 in this direction, referred to as the advance direction, causes movement of the cam ring, due to the co-operation of the peg with the opening 10, and the timing of fuel delivery by the pump is therefore advanced.

It will be appreciated that, in use, at the instant at which the rollers move into engagement with the cam lobes provided on the cam ring, a significant force is transmitted through the cam ring and the peg to the advance piston 12, tending to urge the advance piston 12 towards the right in the orientation illustrated in FIG. 1. The provision of the non-return valve in the channel 46 ensures that any such movement of the advance piston 12 which would otherwise tend to increase fuel pressure within the control chamber 38 is avoided, thereby preventing a reverse flow of fuel into the servo control chamber 37.

In conditions in which the engine is operating at a relatively light load, the pressure of fuel delivered through the light load supply passage 64 to the light load control chamber 60 (signal pressure) is increased. As fuel pressure within the light load control chamber 60 increases, the light load piston 26 is urged against the action of the light load spring 28 to the left in the orientation shown in FIG. 1. Such movement of the light load piston 26 reduces the compression of the spring 30 such that the servo piston 24 is also caused to move with the light load piston 26. The movement of the servo piston 24 permits fuel to flow to the first control chamber 38 from the servo control chamber 37, resulting in movement of the advance piston 12 to advance the timing of fuel delivery by the pump. The position of the light load piston 26 therefore affects the relationship between engine speed and the rate of adjustment of timing of fuel delivery by the pump.

Under such light load conditions, in which the pressure of fuel within the light load chamber 60 is increased to a relatively high level, fuel pressure within the servo piston chamber 27 will also be increased due to the communication path between the light load control chamber 60 and the servo piston chamber 27 through the clearance 29. Beyond a critical signal pressure, any variation in fuel pressure within the servo control chamber 37 due to a subsequent increase in transfer pressure (as a result of increased engine speed) will be insufficient to overcome the combined force of the servo control spring 30 and increased fuel pressure in the servo piston chamber 27. Beyond this critical pressure (i.e. for lower loads) the servo piston 24 is therefore unresponsive to speed-dependent variations in fuel pressure within the servo chamber 37 and, thus, the speed advance scheme of the arrangement is effectively disabled.

Figure 7:
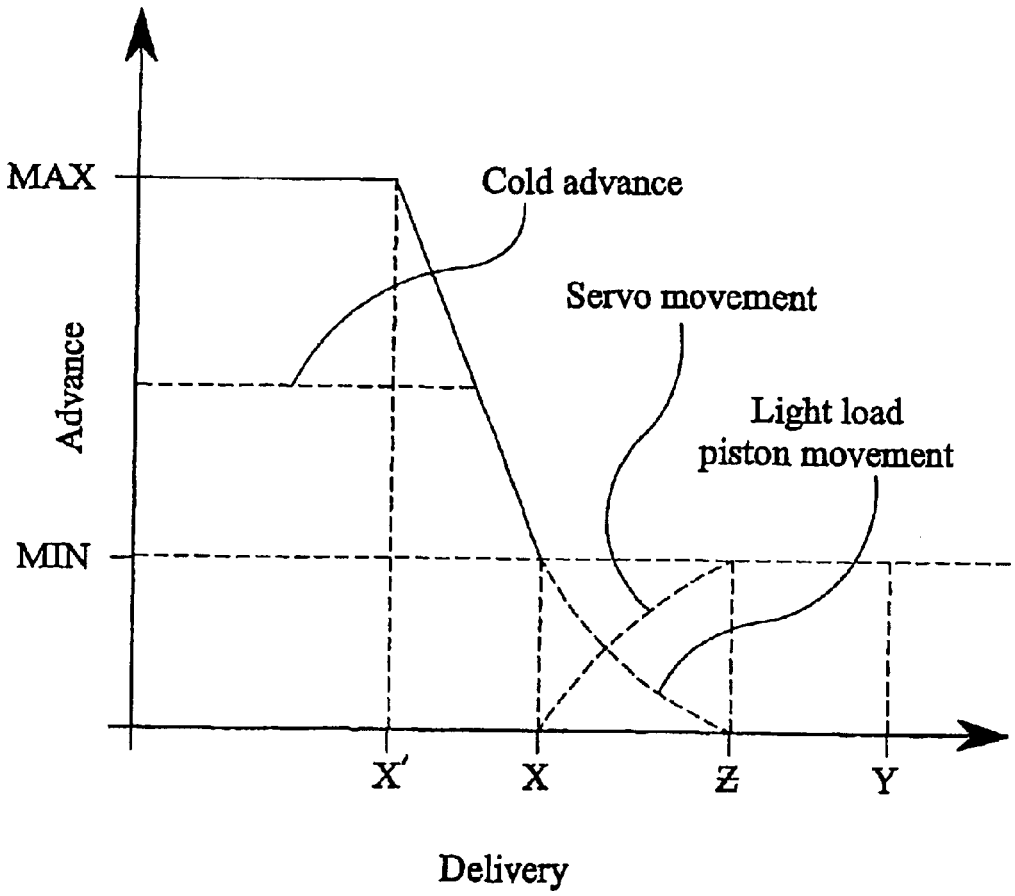
FIG. 7 is a graph to illustrate a typical advance characteristic of the advance arrangement in FIGS. 1 to 3 for a given engine speed.

FIG. 7 is a graph to illustrate the degree of advance of the advance piston 12 as a function of pump delivery (solid line) at a given speed/servo pressure. The response of the servo piston 24 is also shown (dashed line), and this represents movement of the servo piston 24 due to variations in signal pressure within the light load control chamber 60. It can be seen that the response of the servo piston 24 decays to a critical point, X, beyond which (i.e. lower delivery) increasing signal pressure within the light load control chamber 60 does not result in servo movement. The response of the light load piston 26 to changes in signal pressure is also shown (also shown as a dashed line). Beyond the critical point X it will be appreciated that the advance characteristic is governed solely by the behaviour of the light load piston 26.

For the given speed/servo pressure and at delivery Y the servo piston 24 is engaged with the blind end 26*c* of the bore in the second light load piston part 26*b* and the light load piston 26 is in engagement with the step 14*a* in the bore 14 (i.e. a maximum retard position). From the maximum retard position, the light load piston 26 will start to move (corresponding to delivery Z) when fuel pressure within the light load control chamber 60 is increased beyond an amount which is sufficient to overcome the force of the light load control spring 28.

The pre-load of the light load control spring 28, the pre-load of the servo control spring 30 and the rates of the springs 28, 30 may be selected to ensure the delivery Z (for a given speed/servo pressure) at which the light load piston 26 starts to move against the light load control spring 28 in response to increasing signal pressure within the light load control chamber 60 is substantially matched to the point at which the servo piston 24 starts to move in response to increasing signal pressure acting on the end surface 24*b* of the servo piston 24, and also to ensure that the two pistons 26, 24 move at substantially the same rate.

The cold advance characteristic is also shown in FIG. 7, and it is a further requirement that the springs 28, 30 are selected such that the point at which the cold advance is activated is beyond the critical point, X (i.e. for deliveries less than X). This ensures that speed advance is effectively disabled in circumstances in which cold advance is activated. If, for example, the advance scheme were configured such that the critical point is at delivery X', the servo piston 24 remains responsive in conditions in which cold advance is applied, and this is undesirable.

In practice, it may be desirable for the servo pressure at which the servo piston 24 starts to move against the servo control spring 30 and the signal pressure at which the light load piston 26 starts to move against the light load control spring 28 to occur for different deliveries, and/or for the pistons to move at different rates, and this can be achieved by appropriate selection of the pre-loads and rates of the springs 28, 30.

For any engine load operating conditions, the temperature control valve 52 may be activated in order to adjust the timing to compensate for the engine being cold. If the temperature of the engine falls below a predetermined amount, the temperature control valve 52 is activated such that fuel at transfer pressure is able to flow through the temperature control valve 52 into the cold advance supply passage 74. When the advance piston 12 is in the position illustrated in FIG. 1, fuel from the cold advance supply passage 74 is able to flow into the additional recess 62 provided on the outer surface of the advance piston 12, thereby further increasing fuel pressure within the light load control chamber 60. The application of increased fuel pressure to the light load control chamber 60 as a result of activation of the temperature control valve 52 results in movement of the light load piston 26, as described previously, which results in adjustment of the position of the advance piston 12.

If the engine is running under light load conditions, the rate of flow of fuel into the light load control chamber 60 is relatively high such that, even if the advance piston 12 moves to a position in which the cold advance supply passage 74 no longer registers with the recess 62, fuel continues to flow into the light load control chamber 60 and, thus, movement of the light load piston 26 in the advance direction continues.

If, however, the engine is running under high load conditions, such that fuel at reduced pressure is supplied to the light load control chamber 60 through the light load supply passage 64 after the advance piston 12 has moved through a predetermined amount, the cold advance supply passage 74 will no longer register with the recess 62 and fuel flow from the cold advance supply passage 74 into the light load control chamber 60 will cease. As a result, movement of the light load piston 26 in the advance direction (to the left in the orientation illustrated) is limited.

It will be appreciated that the advance characteristic of the arrangement for high and low load operating conditions will be different. Furthermore, the advance characteristic of the arrangement will vary depending on engine temperature.

The lack of response of the servo piston 24 to fuel pressure variations within the servo control chamber 37 is effected upon an increase in fuel pressure within the light load control chamber 60 (and hence within the servo piston chamber 27) beyond the critical pressure arising either as a result of increased signal pressure within the light load control chamber 60 due to light load conditions, or due to increased signal pressure within the light load control chamber 60 due to cold conditions, or if both conditions occurring simultaneously.

The lack of response of the servo piston 24 to speed-dependent pressure variations in the servo control chamber 37 under light load conditions provides a particularly important advantage when the engine is operating under relatively cold conditions, as it ensures no speed advance is applied under conditions in which cold advance is implemented. It is a recognised problem in existing arrangements that the cold advance scheme can become unstable in circumstances in which speed advance is applied. With the present invention, by providing a means for effectively disabling the speed advance scheme under certain operating conditions, it is possible to alter the extent of light load advance under cold conditions whilst avoiding stability problems.

Figure 8:
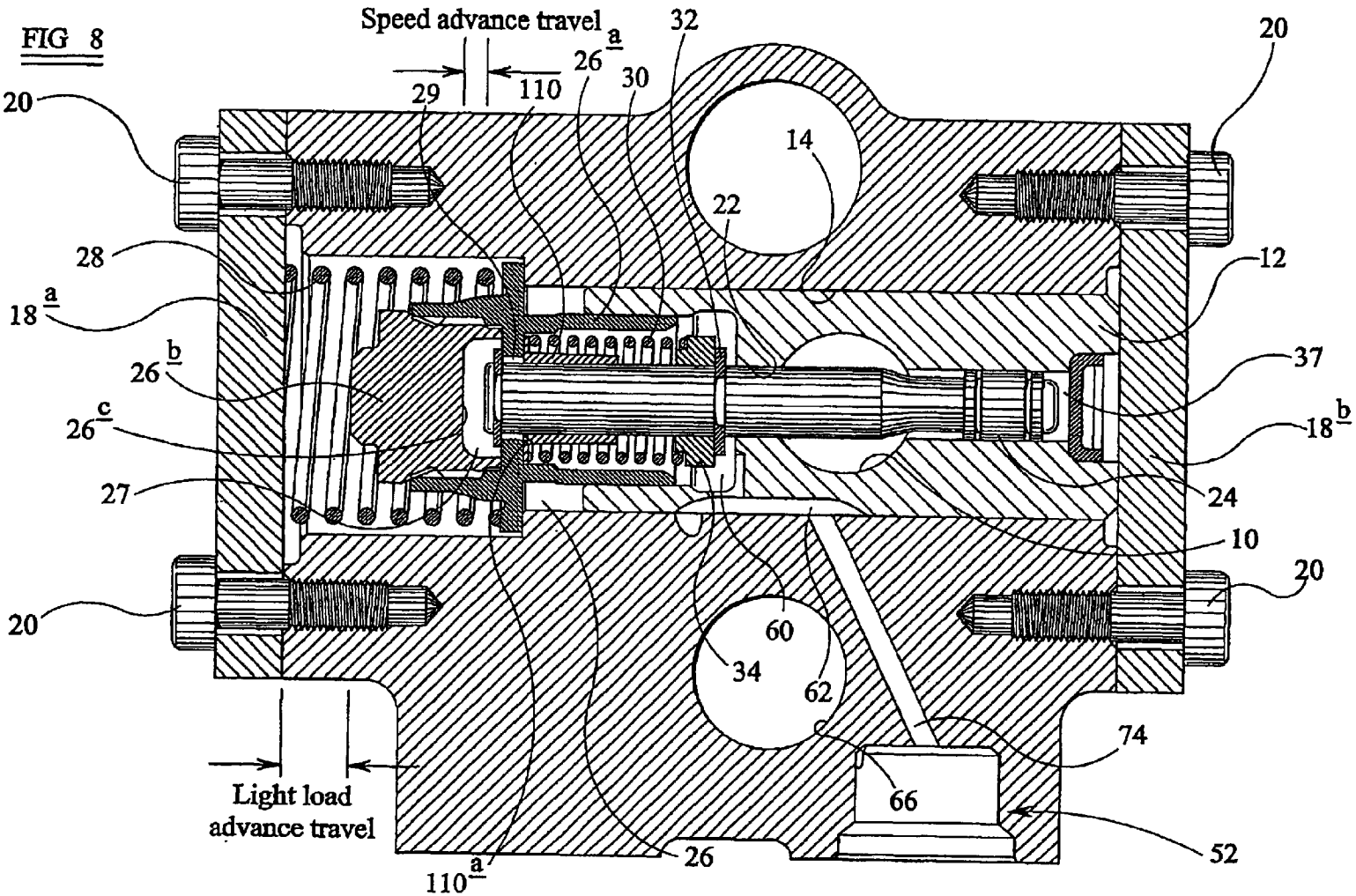
FIG. 8 is a sectional view to illustrate parts of an alternative embodiment of the advance arrangement to that shown in FIG. 1.

As an alternative embodiment to that shown in FIG. 1, FIG. 8 shows an embodiment in which the servo piston 24 is arranged to carry a close fitting sleeve 110 which is biased into engagement with the first part 26*a* of the light load piston 26 by means of the servo control spring 30. The communication path between the light load control chamber 60 and the servo piston chamber 27 is defined by a clearance 29 between the outer surface of the servo piston 24 and the inner portion of the flange on the first part 26*a* of the light load piston 26, as shown in FIG. 1. In addition, the sleeve 110 is provided with an orifice 110*a* which serves to restrict the rate of flow of fuel between the light load chamber 60 and the servo piston chamber 27 and, thus, damps movement of the servo piston 24 relative to the light load piston 26. By varying the diameter of the orifice 110*a*, the rate of fuel flow between the light load chamber 60 and the servo piston chamber 27 can be varied to permit the extent of the damping effect to be varied. The damping effect of the orifice 110*a* is advantageous in that it provides transient smoothing of relative movement between the servo piston 24 and the light load piston 26 in conditions approaching maximum speed advance.

The advance arrangement described with reference to the accompanying Figures incorporates both servo and light load advance schemes, but it is also known in the art for advance arrangements to include only one or the other of servo or light load advance. For example, if only light load advance is incorporated in the arrangement of FIG. 1, the servo piston 24 need not be present (or may be integrally formed with or locked to the light load piston), with signal pressure being supplied to the light load control chamber 60 and the light load piston 26 being moved in response to load dependent variations in signal pressure. Conversely, if only speed advance is required, the light load piston is redundant (or may be locked to the servo piston), with servo pressure supplied to the servo control chamber 37 to move the servo piston 24 in response to variations in transfer pressure. By way of example, an advance scheme incorporating only servo advance may be found, for example, in U.S. Pat. No. 4,408,591.

It will therefore be appreciated that certain aspects of the invention are applicable to advance arrangements which only incorporate one or the other of servo and light load advance. For example, the provision of a metering valve arrangement 80 in the flow path between the transfer pump and the cam box, at a position upstream of the light load supply passage 64 (as shown in FIG. 5), is equally applicable to an advance arrangement having only light load advance. The metering valve arrangement 80 may also be incorporated in an advance arrangement having only speed advance, with the metering valve being arranged to control a flow rate to determine a required servo pressure acting on a servo piston. Similarly, the adjustable valve arrangement 90 shown in FIG. 2 may be incorporated in an advance arrangement having only light load advance. The same applies to the two part light load piston 26*a*, 26*b* to permit adjustment of the range of travel of the light load piston 26.

Although the description hereinbefore is of a fuel pump of the type in which pumping plungers move in a radial direction in order to supply fuel at high pressure to an engine, it will be appreciated that the advance arrangement may be applicable to other types of high pressure fuel pump.

Obviously, many modifications and variations of the present invention are possible in light of the above teachings. The invention may be practiced otherwise than as specifically described within the scope of the appended claims.

What is claimed is:

1. An advance arrangement for use in controlling timing of fuel delivery by a fuel pump for use in an engine comprising;

an advance piston which is slidable within a first bore and which cooperates, in use, with a cam arrangement of a fuel pump to adjust the timing of fuel delivery by the pump, a surface associated with the advance piston being exposed to fuel pressure within a first control chamber;

a servo piston which is slidable within a further bore provided in the advance piston to control the pressure of fuel within the first control chamber, the servo piston being responsive to speed dependent fuel pressure variations within a servo control chamber, thereby to permit adjustment of the timing in response to engine speed;

a light load piston moveable relative to the advance piston against the action of a light load control spring in response to fuel pressure variations within a light load control chamber; an adjuster to permit adjustment of the extent of travel of at least one of the light load piston and the servo piston; and an arrangement for ensuring the servo piston is substantially unresponsive to speed dependent fuel pressure variations within the servo control chamber, in circumstances in which fuel pressure within the light load control chamber is increased beyond a predetermined amount.

2. An advance arrangement as claimed in claim 1, wherein the light load piston is shaped to define, in part, a servo piston chamber in communication with the light load control chamber, whereby fuel pressure within the servo piston chamber acts on an end of the servo piston remote from the servo control chamber.

3. An advance arrangement as claimed in claim 2, wherein the light load control chamber communicates with the servo piston chamber through a clearance defined between respective surfaces of the servo piston and the light load piston.

4. An advance arrangement as claimed in claim 2, including an adjuster for permitting the extent of travel of the servo piston to be adjusted.

5. An advance arrangement as claimed in claim 2, including an adjuster for permitting the extent of travel of the light load piston to be adjusted.

6. An advance arrangement as claimed in claim 4, wherein the light load piston includes first and second parts which are moveable relative to one another to permit adjustment of the extent of travel of at least one of the light load piston and the servo piston.

7. An advance arrangement as claimed in claim 6, wherein the second part of the light load piston is provided with a blind bore which defines, together with an end surface of the servo piston, the servo piston chamber.

8. An advance arrangement as claimed in claim 1, including a temperature control valve operable to control the application of fuel to the light load piston depending upon the engine temperature, thereby to permit adjustment of the timing of fuel delivery depending on engine temperature.

9. An advance arrangement as claimed in claim 8, wherein the temperature control valve is arranged such that, when the engine temperature is less than a predetermined temperature, the temperature control valve is activated so as to permit fuel pressure within the light load control chamber to be increased, the temperature control valve being de-activated when the engine temperature exceeds the predetermined temperature.

10. An advance arrangement as claimed in claim 9, wherein the advance piston is moveable within the first bore in an advance direction, in which the timing of fuelling delivery by the pump is advanced, and a retard direction in which the timing of fuelling delivery by the pump is retarded, the advance arrangement further comprising a cold advance supply passage through which fuel is supplied to the light load control chamber when the temperature control valve is activated, the cold advance supply passage being arranged to communicate with the light load control chamber only when the extent of movement of the advance piston in the advance direction is less than a predetermined amount.

11. An advance arrangement as claimed in claim 10, wherein the advance piston has an outer surface provided with a recess in communication with the light load control chamber, said recess defining a control edge, and whereby communication between the cold advance supply passage and the light load control chamber is broken when the control edge becomes misaligned with the cold advance supply passage upon movement of the advance piston beyond the predetermined amount.

12. An advance arrangement as claimed in claim 1, further comprising;

a light load supply passage for supplying a load dependent signal pressure to the light load control chamber, wherein the light load supply passage communicates with a flow path for fuel between a source of fuel at transfer pressure and a low pressure drain; and a light load control valve arrangement which is operable in response to a load signal to vary the rate of flow of fuel through the flow path and, hence, to vary the signal pressure, thereby to permit the timing under light load conditions to be adjusted, wherein the light load control valve arrangement is arranged in the flow path at a position upstream of the light load supply passage.

13. An advance arrangement as claimed in claims 1, wherein the light load control chamber is provided with a restricted outlet arrangement to permit fuel within the light load control chamber to flow to a low pressure fuel reservoir at a restricted rate, and further comprising a further adjuster for adjusting the effective restriction to fuel flow provided by the restricted outlet arrangement.

14. An advance arrangement as claimed in claim 13, wherein the restricted outlet arrangement comprises a first restricted outlet having a variable diameter, and a second restricted outlet of substantially fixed diameter, whereby the further adjuster is adjustable to vary the diameter of the first restricted outlet.

15. An advance arrangement for use in controlling timing of fuel delivery by a fuel pump for use in an engine comprising:

an advance piston which is slidable within a first bore and which cooperates, in use, with a cam arrangement of a fuel pump to adjust the timing of fuel delivery by the pump, a surface associated with the advance piston being exposed to fuel pressure within a first control chamber;

a servo piston which is slidable within a further bore provided in the advance piston to control the pressure of fuel within the first control chamber, the servo piston being responsive to speed dependent fuel pressure variations within a servo control chamber, thereby to permit adjustment of the timing in response to engine speed;

a light load piston moveable relative to the advance piston against the action of a light load control spring in response to fuel pressure variations within a light load control chamber; and an arrangement for ensuring the servo piston is substantially unresponsive to speed dependent fuel pressure variations within the servo control chamber, in circumstances in which fuel pressure within the light load control chamber is increased beyond a predetermined amount;

wherein the light load control chamber is provided with a restricted outlet arrangement to permit fuel within the list load control chamber to flow to a low pressure fuel reservoir at a restricted rate, and further comprising further adjuster for adjusting the effective restriction to fuel flow provided by the restricted outlet arrangement; and wherein the further adjuster comprises a valve member arranged within an additional bore, whereby adjustment of the position of the valve member within the additional bore permits the diameter of the first restricted outlet to be varied.

16. An advance arrangement as claimed in claim 15, wherein the first restricted outlet is of annular form and is defined, in part, by the valve member.

17. An advance arrangement as claimed in claim 2, wherein the servo piston carries a sleeve provided with an orifice to restrict the rate of flow of fuel between the light load control chamber and the servo piston chamber, thereby to damp movement of the servo piston relative to the light load piston.

18. An advance arrangement for use in controlling timing of fuel delivery by a fuel pump for use in an engine comprising:

an advance piston which is slidable within a first bore and which cooperates, in use, with a cam arrangement of a fuel pump to adjust the timing of fuel delivery by the pump, a surface associated with the advance piston being exposed to fuel pressure within a first control chamber, a piston moveable relative to the advance piston against the action of a control spring in response to fuel pressure variations within a control chamber, a supply passage for supplying fuel at a signal pressure to the control chamber, wherein the supply passage communicates with a flow path between a source of fuel at transfer pressure and a low pressure drain;

an adjuster to permit adjustment of the extent of travel of the piston; and a control valve arrangement, operable to vary the rate of flow of fuel through the flow path and, hence, to vary the signal pressure, wherein the control valve arrangement is arranged in the flow path at a position upstream of the supply passage.

19. An advance arrangement as claimed in claim 18, wherein the piston takes the form of a light load piston which is moveable relative to the advance piston against the action of a light load control spring in response to load dependent signal pressure variations within a light load control chamber, and further comprising a servo piston which is slidable within a further bore provided in the advance piston to control the pressure of fuel in the first control chamber, the servo piston being responsive to speed dependent fuel pressure variations within a servo control chamber, thereby to permit adjustment of the timing in response to engine speed.

20. An advance arrangement as claimed in claim 19, wherein the light load control chamber is provided with a restricted outlet arrangement to permit fuel within the light load control chamber to flow to a low pressure fuel reservoir at a restricted rate.

21. An advance arrangement as claimed in claim 20, and also comprising a further adjuster for permitting the effective restriction to fuel flow provided by the restricted outlet arrangement to be varied.

22. An advance arrangement as claimed in claim 21, wherein the restricted outlet arrangement comprises a first restricted outlet of variable diameter and a second restricted outlet of substantially fixed diameter, further comprising adjustment means for adjusting the effective diameter of the first restricted outlet, thereby to permit the effective restriction to fuel flow provided by the restricted outlet arrangement to be varied.

23. An advance arrangement for use in controlling timing of fuel delivery by a fuel pump for use in an engine, the advance arrangement comprising an advance piston which is slidable within a first bore and which cooperates, in use, with a cam arrangement of a fuel pump to adjust the timing of fuel delivery by the pump, a surface associated with the advance piston being exposed to fuel pressure within a first control chamber, a piston moveable relative to the advance piston against the action of a control spring in response to fuel pressure variations within a control chamber, wherein the control chamber is provided with a restricted outlet arrangement to permit fuel within the control chamber to flow to a low pressure fuel drain at a restricted rate, an adjuster to permit adjustment of the extent of travel of the piston, and an adjuster for permitting the effective restriction to fuel flow provided by the restricted outlet arrangement to be varied.

24. An advance arrangement as claimed in claim 23, wherein the piston takes the form of a light load piston which is moveable relative to the advance piston against the action of a light load control spring in response to load dependent signal pressure variations within a light load control chamber, further comprising a servo piston which is slidable within a further bore provided in the advance piston to control the pressure of fuel in the first control chamber, the servo piston being responsive to speed dependent fuel pressure variations within a servo control chamber, thereby to permit adjustment of the timing in response to engine speed.

25. An advance arrangement for use in controlling timing of fuel delivery by a fuel pump for use in an engine comprising:

an advance piston which is slidable within a first bore and which cooperates, in use, with a cam arrangement of a fuel pump to adjust the timing of fuel delivery by the pump, a surface associated with the advance piston being exposed to fuel pressure within a first control chamber; and a light load piston moveable relative to the advance piston against the action of a light load control spring in response to load dependent fuel pressure variations within a light load control chamber, thereby to adjust the timing under light load conditions, the light load piston including first and second parts which are moveable relative to one another to permit adjustment of the extent of travel of the light load piston.

26. An advance arrangement as claimed in claim 25, and further comprising a servo piston which is slidable within a further bore provided in the advance piston to control the pressure of fuel in the first control chamber, the servo piston being responsive to speed dependent fuel pressure variations within a servo control chamber, thereby to permit adjustment of the timing in response to engine speed.

27. An advance arrangement as claimed in claim 26, wherein relative movement of the first and second parts permits adjustment of the extent of travel of at least one of the servo piston and the light load piston.

28. An advance arrangement as claimed in claim 25, wherein the first and second parts of the light load piston are in screw threaded connection with one another.

* * * * *